US006835906B2

(12) United States Patent
Okamoto et al.

(10) Patent No.: US 6,835,906 B2
(45) Date of Patent: Dec. 28, 2004

(54) PRESS BUTTON SWITCH AND METHOD OF MANUFACTURING THE SAME

(75) Inventors: Satoshi Okamoto, Hyogo (JP); Toshiya Inubushi, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 58 days.

(21) Appl. No.: 09/843,073

(22) Filed: Apr. 27, 2001

(65) Prior Publication Data

US 2001/0024703 A1 Sep. 27, 2001

Related U.S. Application Data

(63) Continuation of application No. PCT/JP99/04643, filed on Aug. 27, 1999.

(51) Int. Cl.[7] ..... H01H 13/14

(52) U.S. Cl. ..... 200/341; 200/317; 200/310; 200/313; 200/314; 200/345; 428/195; 428/336

(58) Field of Search ..... 200/341, 279, 200/512–517, 308, 310–314, 317, 329; 428/195, 215, 688, 698, 332, 336

(56) References Cited

U.S. PATENT DOCUMENTS 6,084,190 A * 7/2000 Kenmochi ..... 200/341
6,322,875 B1 * 11/2001 Kimura ..... 428/195.1

FOREIGN PATENT DOCUMENTS

| | | |
|---|---|---|
| EP | 0 886 290 A1 | 12/1998 |
| EP | 0 886 291 A1 | 12/1998 |
| JP | 61-6224 | 1/1986 |
| JP | 8-11419 | 1/1996 |
| JP | 10-289632 | 10/1998 |
| JP | 10-289633 | 10/1998 |
| JP | 10-326533 | 12/1998 |

* cited by examiner

*Primary Examiner*—Lincoln Donovan
*Assistant Examiner*—Jennifer A. Poker
(74) *Attorney, Agent, or Firm*—Rothwell, Figg, Ernst & Manbeck, PC

(57) ABSTRACT

A plating layer (or vapor deposition layer) which exhibits a metallic color is formed on the surface of a molded resin part. A color film with transmittance which is molded and which has a desired color for design is formed on the surface of the above plating layer (or vapor deposition layer). This color film comprises moldable materials such as resin including, for example, polymer compounds such as PET, PC, urethane or combinations of these. Thereby, a press button switch can be gained which imparts a feeling of high quality through a metallic finish design, of which the degree of design freedom is high and which can prevent color unevenness of the key top from occurring.

12 Claims, 8 Drawing Sheets

PRESS BUTTON SWITCH AND METHOD OF MANUFACTURING THE SAME

REFERENCE TO RELATED APPLICATION

This application is a continuation of International Application No. PCT/JP99/04643, whose International filing date is Aug. 27, 1999, the disclosure of which is incorporated by reference herein. The present application has not been published in English.

BACKGROUND OF THE INVENTION

1. Field of the Invention

The present invention relates to a press button switch and a method of manufacturing the same.

2. Description of the Background Art

In recent years, as for the key top (part exposed from the housing) of press button switches used in cellular phones, or the like, a metallic finish has been used as a design to impart a feeling of high quality. In the following a conventional press button switch comprising the key top with a metallic finish design is described.

FIG. 15 is a cross-sectional view schematically showing the structure of a conventional press button switch. Referring to FIG. 15, the conventional press button switch has a plating layer 101, a molded resin part 103 and a base rubber 104 making up its main parts. The plating layer 101 is formed on the surface of the molded resin part 103 which is a base body of the press button. The molded resin part 103 is bonded to the base rubber 104 by means of the adhesive layer 106. An actuator part 105 is formed to be integrated into the base rubber 104. The actuator part 105 is a part which makes the switching possible by pressing a dome-shaped metal plate 108.

Here, such a press button switch is arranged on a substrate 107 and is arranged so that the key top is exposed from the housing 110.

The plating layer 101 comprises, for example, a chemical nickel plating layer, an electrolysis copper plating layer, an electrolysis nickel plating layer or an electrolysis chromium plating layer.

Conventionally, as described above, a plating is applied onto the surface of the molded resin part 103 so that the key top has the metallic finish design. However, in such a method by means of plating only the color of the metal itself can be selected for the key top design and, therefore, the problem arises that designs cannot be freely created.

As for a method of achieving colors which cannot be created by using only the metal itself, there is a method for carrying out a color coating on the top surface of the plating layer 101. However, color coating is inferior in wear resistant properties and easily comes off. Therefore, when the switching operation is repeated, the color coating comes off and the plating layer 101 is exposed so that the problem arises that unevenness of color occurs.

SUMMARY OF THE INVENTION

The present invention provides a press button switch and a method of manufacturing the same which can impart a feeling of high quality through a metallic finish design, of which the design degree freedom is high and of which color unevenness of the key top can be prevented from occurring.

A press button switch according to the present invention is a press button switch for a switching operation through the pressing of a button which comprises a base body of the button, an undercoat layer which is formed on the surface of the base body and of which the surface, at least, exhibits a metallic color and a film which is formed over the surface of the undercoat layer so as to cover the undercoat layer and which allows the transmission of the metallic color of the undercoat layer.

According to a press button switch of the present invention, a formed film is used of which the material quality is superior in wear resistance properties to a coating film. Therefore, the peeling off of the film during usage can be prevented so that unevenness of color due to exposure of the undercoat layer can be prevented from occurring.

In addition, since the film is made of a material which allows the metallic color of the undercoat layer to be transmitted and, therefore, a metallic finish design can be achieved so as to impart a feeling of high quality.

It is preferable for the film to be a color film in the above described press button switch.

Thereby, the film can be colored while reflecting the metallic color of the undercoat layer so that the degree of design freedom can be enhanced.

It is preferable for the film to be a colorless film in the above described press button switch.

Thereby, the metallic color of the undercoat layer can be clearly transmitted.

It is preferable for the above described press button switch to further comprise a layer with transmittance which has a designed pattern between the undercoat layer and the film.

Thereby, the degree of design freedom can be enhanced.

It is preferable for the undercoat layer to be a metal layer in the above described press button switch.

Thereby, an undercoat layer which exhibits a metallic color can be formed by means of plating or vapor deposition.

It is preferable for the undercoat layer to be a printed layer where a plate-type finish is applied to the surface in the above described press button switch.

Thereby, a desired plate-type finish design can be gained by means of printing process so that the degree of design freedom can be enhanced.

It is preferable for the above described press button switch to further comprise a protective film for preventing heat from being conveyed from the base body to the undercoat layer and the protective film is formed between the base body and the undercoat layer.

Thereby, heat can be prevented from being conveyed from the base body side to the undercoat layer so that color change, or the like, of the undercoat layer can be prevented.

It is preferable for the base body to contain an actuator formed for a switching operation in the above described press button switch.

Thereby, it becomes unnecessary to separately provide an actuator from the base body in order to simplify the design of the parts.

It is preferable for the base body to have a hollow area in the above described press button switch.

Thereby, it can be designed to be made lighter.

The method of manufacturing a press button switch according to the present invention is a method of manufacturing a press button switch for a switching operation through the pressing of a button which comprises the step of formation of a film with transmittance in a button shape and, through contact with the button shape of a layered film wherein an undercoat layer, of which the surface exhibits a metallic color, and said film are layered, a base body fixed to said layered film is formed.

In a method of manufacturing a press button switch according to the present invention, a press button switch which can impart a feeling of high quality through a metallic finish design with a high degree of design freedom and which can prevent the unevenness of color through frictional wear from occurring can be manufactured by a simple method.

Here, the step of a formation of the film in a button shape may either be the step of formation of, solely, the film into a button shape or the step of a formation of a film and an undercoat layer in the layered condition in a button shape. When the film is formed, solely, into a button shape an undercoat layer is formed following the shape of the film after the formation.

It is preferable for the base body to be formed after the formation of the film into a button shape in the above described method of manufacturing a press button switch.

Thereby, a precise button shape can be gained.

It is preferable for the base body to be formed simultaneously at the formation of the film in a button shape in the above described method of manufacturing a press button switch.

Thereby, the formation of the base body and the formation into a button shape can be carried out simultaneously and the step thereof can be designed to be simplified.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

In the following, the embodiments of the present invention are described in reference to the drawings.

First Embodiment

Figure 1:
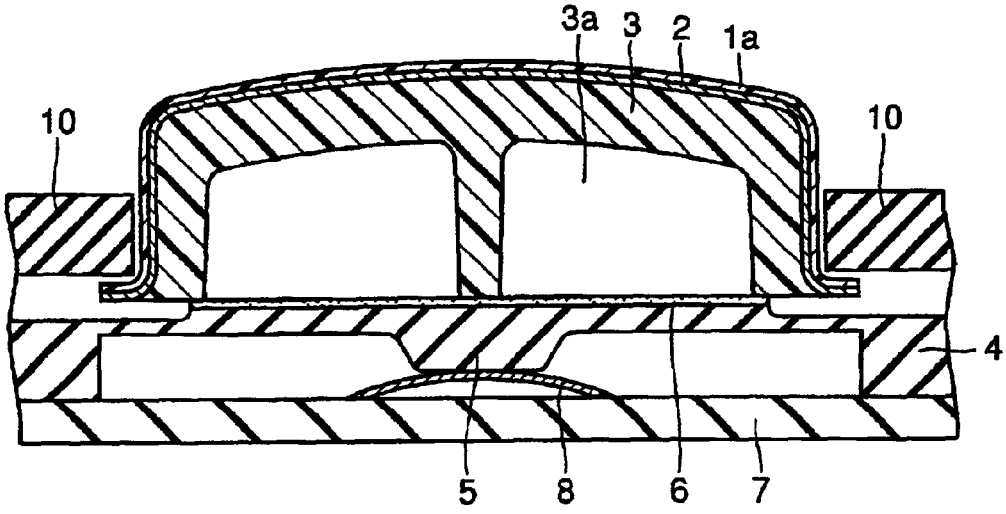
FIG. 1 is a cross-sectional view schematically showing a structure of a press button switch according to the first embodiment of the present invention.

Referring to FIG. 1, a press button switch has a color film 1*a*, a plating layer (or vapor deposition layer) 2, a molded resin part 3 and a base rubber 4 making up its main parts. The molded resin part 3 is formed of resin which becomes a base body of the press button. The plating layer (or vapor deposition layer) 2 which exhibits a metallic color as an undercoat layer is formed on the surface of the above molded resin part 3. This plating layer (or vapor deposition layer) 2 is made of simple metal such as Cr (chromium), Al (aluminum), Ni (nickel), Au (gold), Cu (copper) or an alloy of these. Moreover, particularly Cr or Al among these metals exhibits a silvery metallic color so as to be able to make the pattern of the color film 1*a* more vivid than other metal materials. A molded color film 1*a* is provided on this plating layer (or vapor deposition layer) 2. The color film 1*a* has the desired color for design and has the property to allow metal color of the plating layer (or vapor deposition layer) 2 to transmit. This color film 1*a* comprises moldable materials, such as resin, including polymer compounds such as PET (polyethylene terephthalate), PC (polycarbonate), urethane or combinations of these.

The molded resin part 3 is bonded to the base rubber 4 via the adhesive layer 6. The adhesive layer 6 comprises, for example, thermosetting adhesive or UV adhesive. The base rubber 4 comprises, for example, silicon rubber and has an actuator (protruding part) 5 which is integrated. The actuator 5 is a part which makes the switching operation possible by the pressing of a dome shaped metal plate 8 supported by the substrate 7.

The key top of this press button switch is exposed from the housing 10 so that the switching operation is carried out by pressing this key top part.

Figure 2:
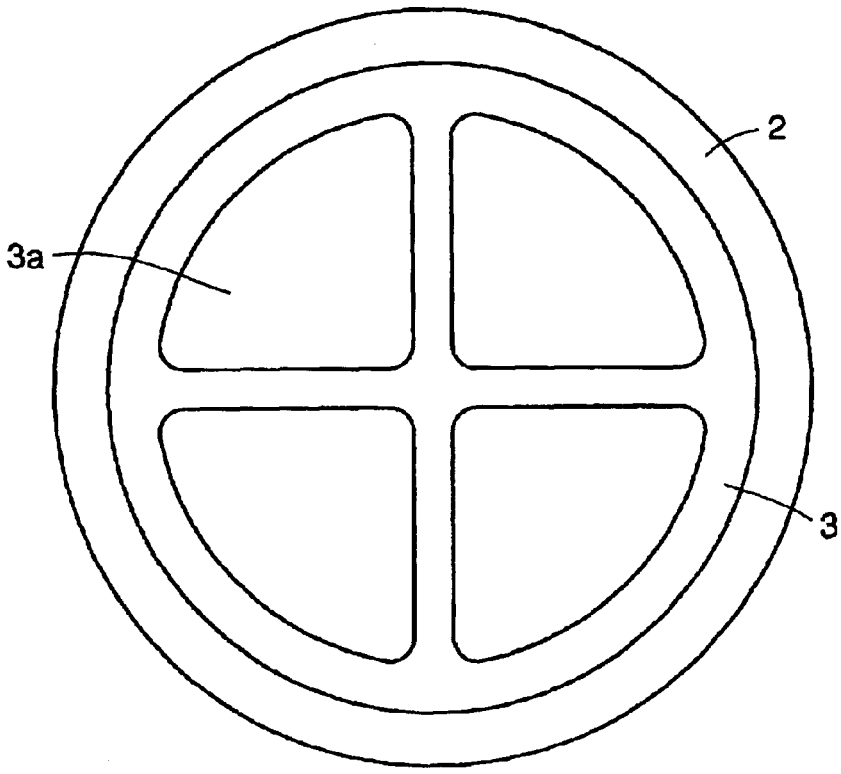
FIG. 2 is a view of the molded resin part of FIG. 1 viewed from the lower side.

Here, the molded resin part 3 may have the structure wherein a hollow area 3*a* is provided as shown in FIG. 2 or may have a solid structure without the hollow area 3*a*. Here, it is preferable to provide the hollow area 3*a* for the purpose of weight reduction.

Next, a process of the present embodiment is described.

Figure 3:
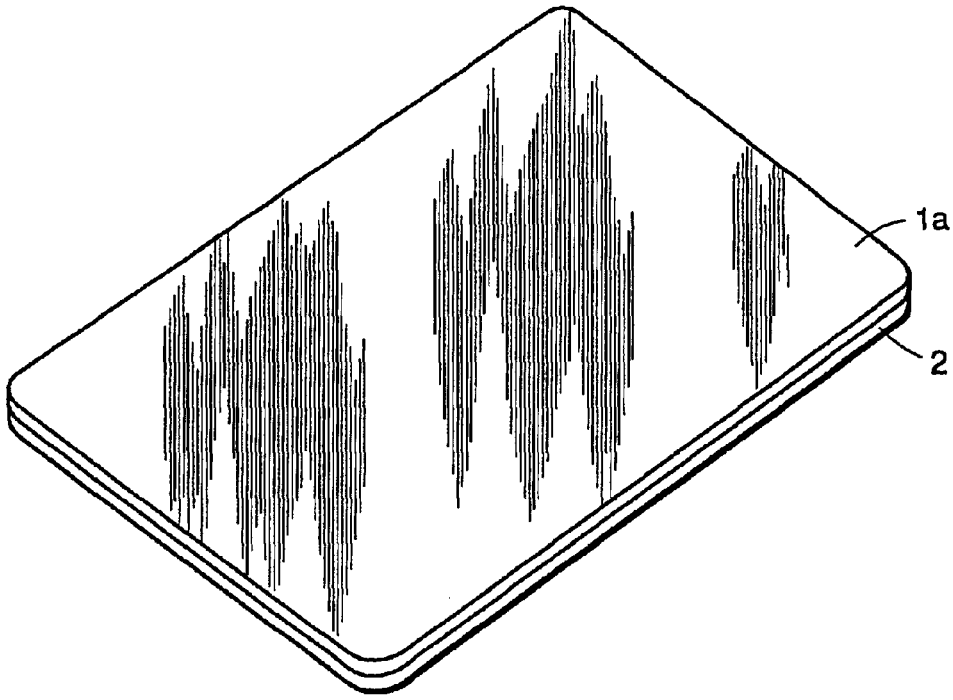
FIGS. 3 to 5 are views showing a method of manufacturing a press button switch according to the first embodiment of the present invention.

Referring to FIG. 3, first a layered film is prepared by forming a plating layer (or vapor deposition layer) 2 through, for example, plating or vapor deposition on the back surface of the color film 1*a* with transmissibility which has a desired color for design. At this time, in the case that the plating layer 2 is formed it is preferable to use Cr as the material and in the case that the vapor deposition layer 2 is formed it is preferable to use Al.

Figure 4:
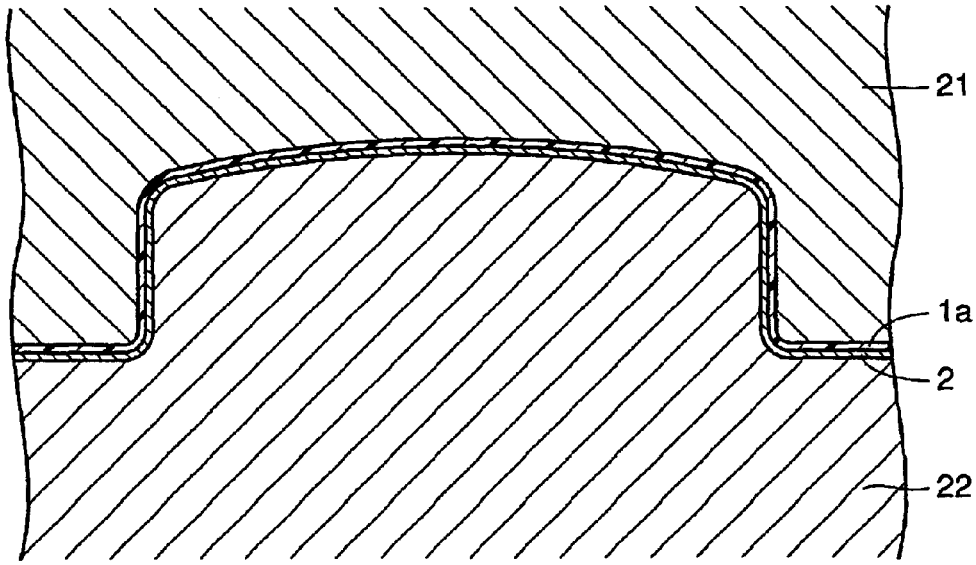

Referring to FIG. 4, this layered film 1*a*, 2 is press molded by using a mold 21, 22 and, thereby, is molded into a substantially curved form in a button shape. Here, the molding method is not limited to the above described method and the film may be molded into a substantially curved form through a vacuum molding.

Figure 5:
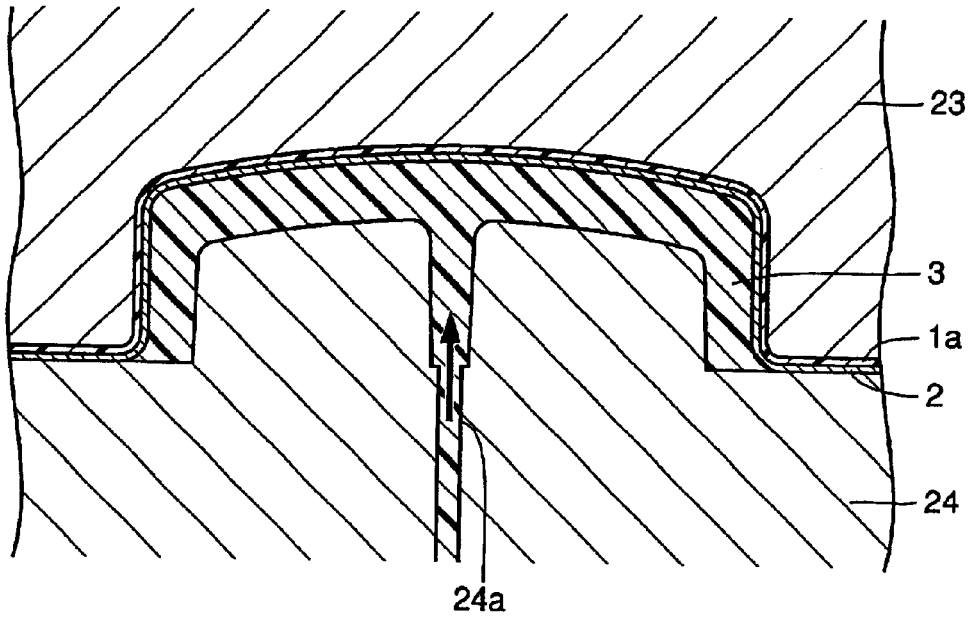

Referring to FIG. 5, the molded layered film 1*a*, 2 is fitted into a mold 23, 24 for injection molding. After that the molded resin part 3 is formed by making resin flow in from the gate 24*a* of the mold 24.

After that, the desired parts of the layered film 1*a*, 2 are cut off and then bonded to the base rubber 4 via the adhesive layer 6 as shown in FIG. 1. As for the material for this adhesive layer 6 thermosetting adhesive, for example, can be used and, in addition, UV adhesive can also be used. Thereby, a press button switch of the present embodiment as shown in FIG. 1 is manufactured.

Though, in the above described method, injection molding of resin is carried out after the layered film 1*a*, 2 is molded into a substantially curved form, this molding of the material into a substantially curved form and the injection molding of the material may be carried out simultaneously. In the following this method is described.

Figure 6:
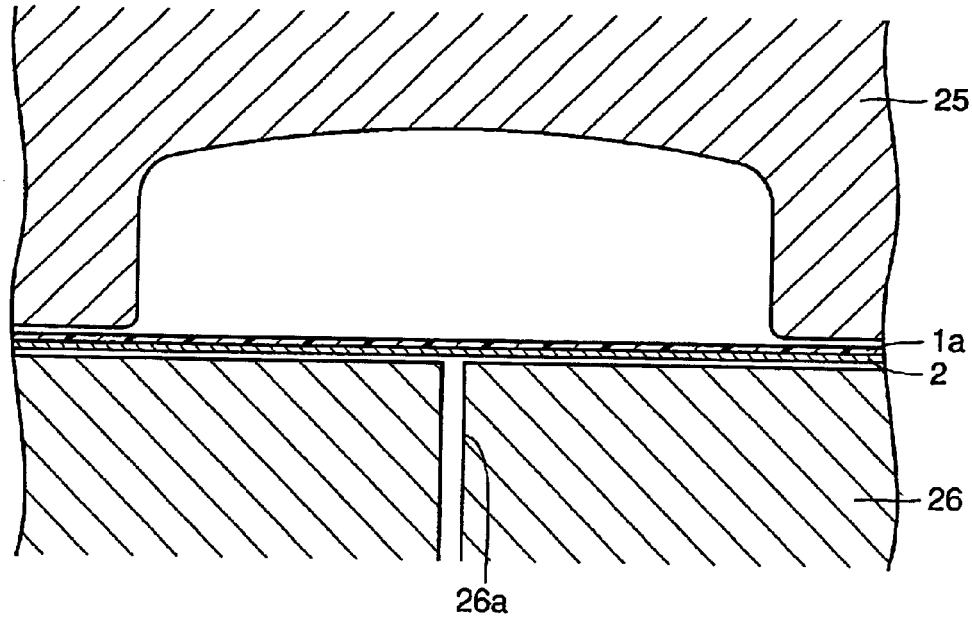
FIGS. 6 and 7 are views showing another method of manufacturing a press button switch according to the first embodiment of the present invention.
Figure 7:
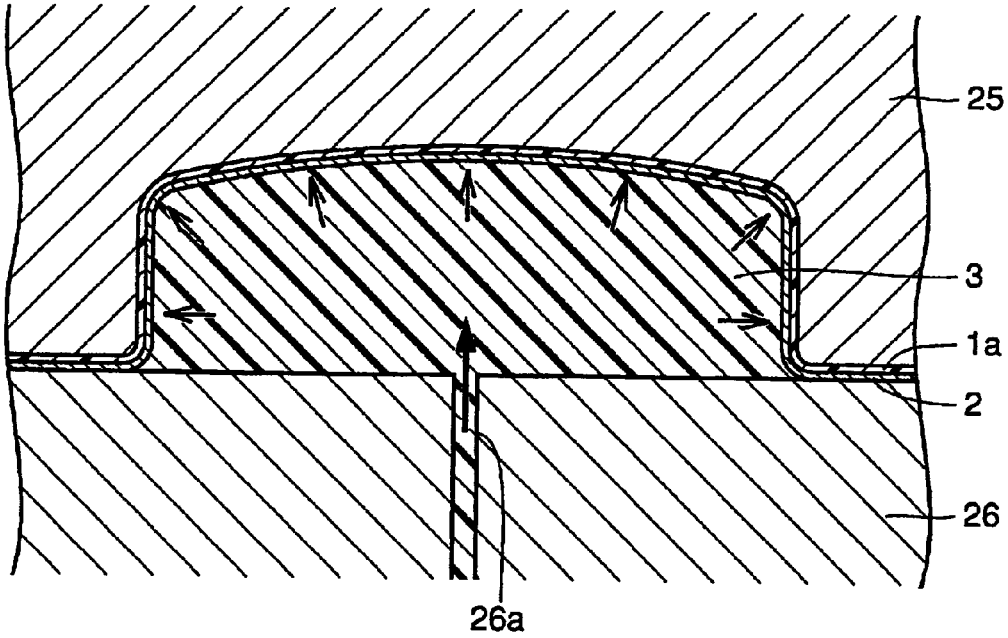

The layered film 1*a*, 2 gained by the step as shown in FIG. 3 is sandwiched in the mold 25, 26 as shown in FIG. 6. After that, resin is injected from the gate 26*a* of the mold 26 as shown in FIG. 7. Through the injection pressure of this resin, the layered film 1*a*, 2 is molded into a substantially curved form and the molded resin part 3 is formed. Though in this case, the molded resin part 3 has a solid structure without a hollow area, a hollow area may be provided through the following processing.

After that, in the same was as is above described, a press button switch of the present embodiment is manufactured by bonding the molded resin part 3 to the base rubber 4 via the adhesive layer 6 as shown in FIG. 1.

In the present embodiment, the surface of the plating layer (or vapor deposition layer) 2 is covered with a color film 1*a* which comprises polymer compounds, or the like, with high wear resistance. Thereby, the peeling of the color film 1*a* can be prevented and the color unevenness due to the partial exposure of the plating layer (or vapor deposition layer) 2 can be prevented from occurring.

In addition, the color film 1*a* comprises the material which allows the metallic color of the plating layer (or vapor deposition layer) 2 to transmit so as to enable the achievement of a metallic finish design and to impart a feeling of high quality.

In addition, it is possible to color the color film 1*a* so as to enable the enhancement of the degree of design freedom through the coloring.

Second Embodiment

Figure 8:
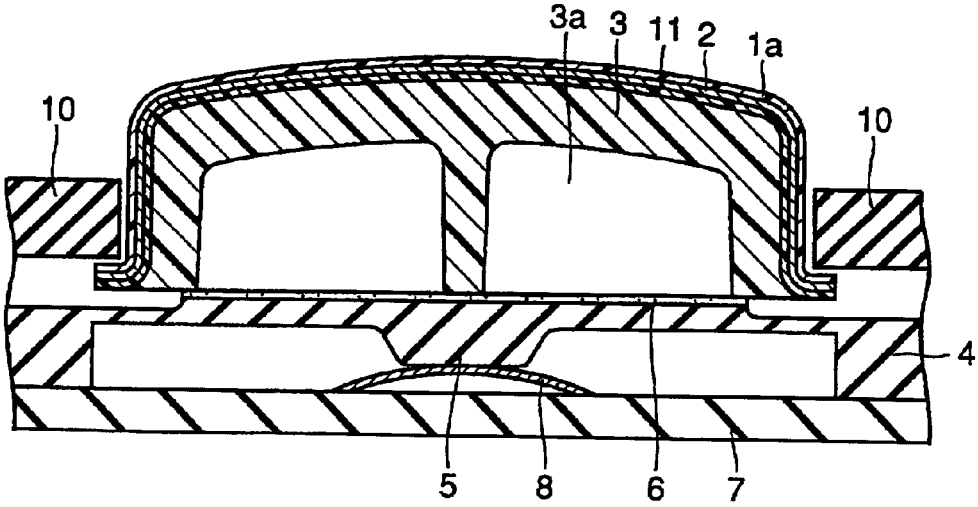
FIG. 8 is a cross-sectional view schematically showing a structure of a press button switch according to the second embodiment of the present invention.

Referring to FIG. 8, a press button switch of the present embodiment is different from the structure of the first embodiment as shown in FIG. 1 in the point that a protective film layer 11 is added. This protective film layer 11 is provided between the molded resin part 3 and the plating layer (or vapor deposition layer) 2, and comprises, for example, polymer compounds such as PET, PC, urethane or combinations of these.

Here, the structure of other parts is approximately the same as in the above described first embodiment the same parts are referred to by the same numerals of which the descriptions are omitted.

According to a process of the present embodiment first a layered structure of the color film 1*a*, the plating layer (or vapor deposition layer) 2 and the protective film layer 11 is prepared. After that, injection molding may be carried out after molding into a substantially curved form as shown in FIGS. 4 and 5 or injection molding may be carried out at the same time as molding into a substantially curved form as shown in FIGS. 6 and 7.

In the present embodiment a protective film layer 11 is provided between the molded resin part 3 and the plating layer (or vapor deposition layer) 2. Therefore, heat can be restrained from being conveyed to the plating layer (or vapor deposition layer) 2 at the time of injection molding for the formation of the molded resin part 3 so that the color change, or the like, of the plating layer (or vapor deposition layer) 2 due to heat can be prevented.

Here, even in the case that a printed layer or a coating layer is provided instead of the protective film layer 11 the same effects as those in the present embodiment can be gained.

Third Embodiment

Figure 9:
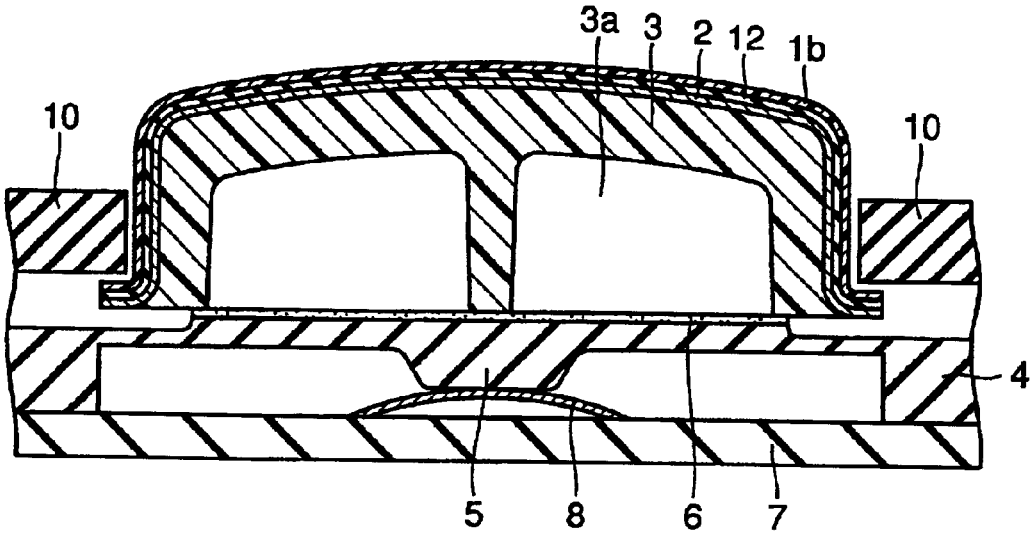
FIG. 9 is a cross-sectional view schematically showing a structure of a press button switch according to the third embodiment of the present invention.

Referring to FIG. 9, a press button switch of the present embodiment is different from the structure as shown in FIG. 1 in the point that a printed layer (or coating layer) 12 and a transparent film 1*b* are formed on the plating layer (or vapor deposition layer) 2. This printed layer (or coating layer) 12 has a desired design and has the property which allows the metallic color of the undercoat plating layer (or vapor deposition layer) 2 to be transmitted. The printed layer (or coating layer) 12 has a desired design applied with ink or paint. The transparent film 1*b* is colorless and has the property that allows the undercoat color to be transmitted. This transparent film 1*b* comprises moldable material, such as resin, including, for example, polymer compounds such as PET, PC, urethane or combinations of these.

Here, the other parts of the structure are almost the same as in the above described first embodiment and, therefore, the same parts are referred to by the same numerals of which the descriptions are omitted.

According to a process of the present embodiment, first a layered structure of the transparent film 1*b*, the printed layer (or coating layer) 12 and the plating layer (or vapor deposition layer) 2 is prepared. After that, injection molding may be carried out after molding the material into a substantially curved form as shown in FIGS. 4 and 5 injection molding may be carried out simultaneously to mold the material into a substantially curved form as shown in FIGS. 6 and 7.

In the present embodiment a transparent film 1*b* which comprises polymer compounds, or the like, of which the wear resistance is higher than that of a coating film is provided. Therefore, peeling of the transparent film 1*b* can be prevented so that the color unevenness due to the exposure of the undercoat layer can be prevented from occurring.

In addition, since a printed layer (or coating layer) 12 is used, the metallic color of the plating layer (or vapor deposition layer) 2 can be reflected while the degree of design freedom can be enhanced.

In addition, since the transparent film 1*b* and the printed layer (or coating layer) 12 comprises materials which have transmissibility the metallic finish design of the plating layer (or vapor deposition layer) 2 can be reflected while imparting a feeling of high quality.

Fourth Embodiment

Figure 10:
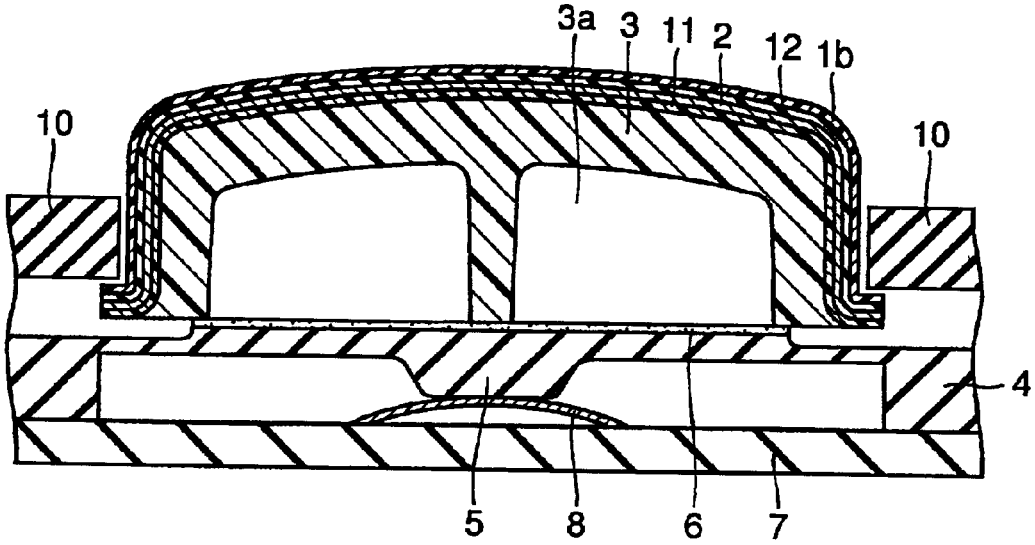
FIG. 10 is a cross-sectional view schematically showing a structure of a press button switch according to the fourth embodiment of the present invention.

Referring to FIG. 10, a press button switch of the present embodiment is different from the structure of the third embodiment in the point that a protective film layer 11 is added. This protective film layer 11 is provided between the molded resin part 3 and the plating layer (or vapor deposition layer) 2 and comprises, for example, polymer compounds such as PET, PC, urethane or combinations of these.

Here, the other parts of the structure are almost the same as in the above described third embodiment and, therefore, the same parts are referred to by the same numerals of which the descriptions are omitted.

According to a process of the present embodiment, first a layered structure of the transparent film 1*b*, the printed layer 12, the plating layer 2 and the protective film layer 11 is prepared. After that, injection molding may be carried out after molding the material into a substantially curved form as shown in FIGS. 4 and 5 or injection molding may be carried out simultaneously to mold the material into a substantially curved form as shown in FIGS. 6 and 7.

In the present embodiment, a protective film layer 11 is provided between the molded resin part 3 and the plating layer 2 and, therefore, heat can be restrained from being conveyed to the plating layer 2 at the time of injection molding for the formation of the molded resin part 3 so that color change, or the like, of the plating layer (or vapor deposition layer) 2 due to heat can be prevented.

Here, even in the case that a printed layer or a coating layer is provided instead of the protective film layer 11, the same effects as in the present embodiment can be gained.

Fifth Embodiment

Figure 11:
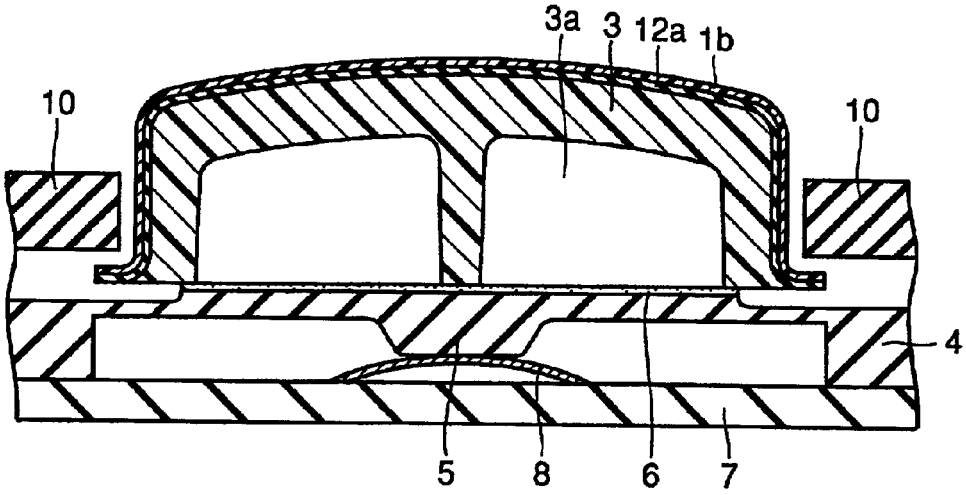
FIG. 11 is a cross-sectional view schematically showing a structure of a press button switch according to the fifth embodiment of the present invention.

Referring to FIG. 11, a press button switch of the present embodiment is different from the structure of the first embodiment in the point that a plating finish printed layer 12*a* and a transparent film 1*b* are provided on the molded resin part 3. The plating finish printed layer 12*a* has the plating finish and exhibits a metallic color. The transparent film 1*b* is colorless and has the property that allows the metallic color of the plating finish printed layer 12*a* to be transmitted. This transparent film 1*b* comprises moldable material such as resin and comprises, for example, polymer compounds such as PET, PC, urethane or combinations of these.

Here the other parts of the structure are almost the same as in the above described first embodiment and, therefore, the same parts are referred to by the same numerals, of which the descriptions are omitted.

According to a process of the present embodiment, first a plating finish printed layer 12*a* is provided on the back surface of the transparent film 1*b*. After that, injection molding may be carried out after molding the material into a substantially curved form as shown in FIGS. 4 and 5 or injection molding may be carried out simultaneously to mold the material into a substantially curved form as shown in FIGS. 6 and 7.

In the present embodiment the plating finish printed layer 12*a* is provided so that it is not necessary to provide a plating layer (or vapor deposition layer), and a design with metallic finish can be achieved. In addition, the plating finish printed layer 12*a* can express a variety of types of plating finish through printing so as to enable the enhancement of the degree of design freedom.

Sixth Embodiment

Figure 12:
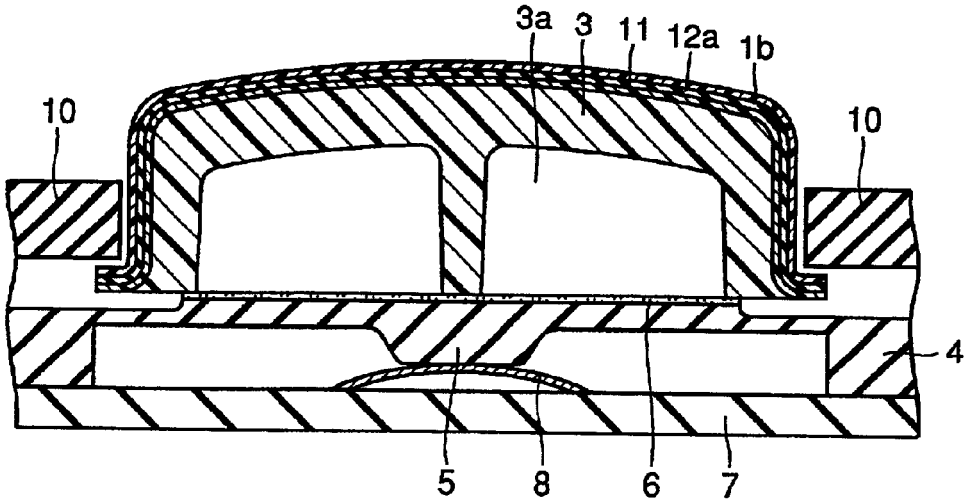
FIG. 12 is a cross-sectional view schematically showing a structure of a press button switch according to the sixth embodiment of the present invention.

Referring to FIG. 12, a press button switch of the present embodiment is different from the structure of the fifth embodiment in the point that a protective film layer 11 is added. This protective film layer 11 is provided between the molded resin part 3 and the plating finish printed layer 12*a* and comprises, for example, polymer compounds such as PET, PC, urethane or combinations of these.

Here, the other parts of the structure are almost the same as in the above described fifth embodiment and, therefore, the same parts are referred to by the same numerals, of which the descriptions are omitted.

According to a process of the present embodiment, first a layered structure of the transparent film 1*b*, the plating finish printed layer 12*a* and the protective film layer 11 is prepared. After that, injection molding of the material may be carried out after molding the material into a substantially curved form as shown in FIGS. 4 and 5 or injection molding of the material may be carried out simultaneously to mold the material into a substantially curved form as shown in FIGS. 6 and 7.

In the present embodiment, since a protective film layer 11 is provided between the molded resin part 3 and the plating finish printed layer 12*a*, heat can be restrained from being conveyed to the plating finish printed layer 12*a* at the time of injection molding for the formation of the molded resin part 3.

Here, even in the case that a printed layer or a coating layer is provided instead of the protective film layer 11, the same effects as in the present embodiment can be gained.

Seventh Embodiment

Figure 13:
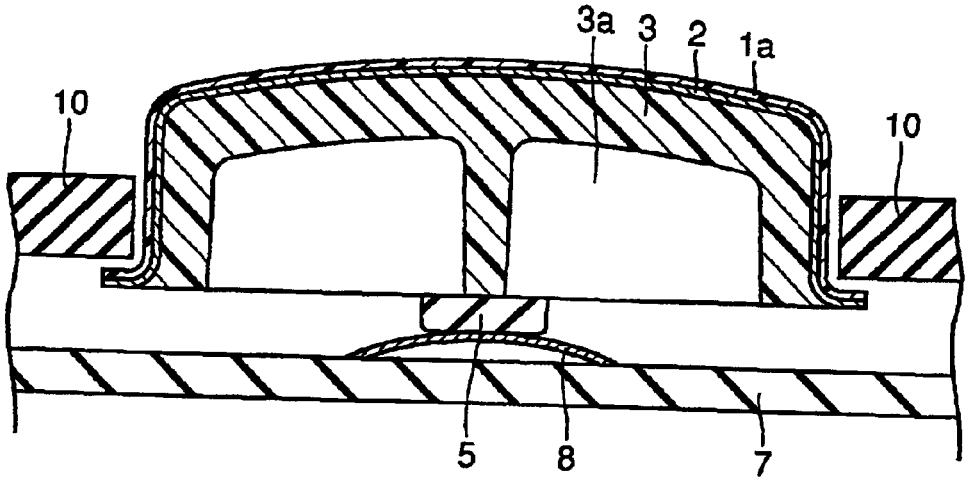
FIG. 13 is a cross-sectional view schematically showing a structure of a press button switch according to the seventh embodiment of the present invention.
Figure 14:
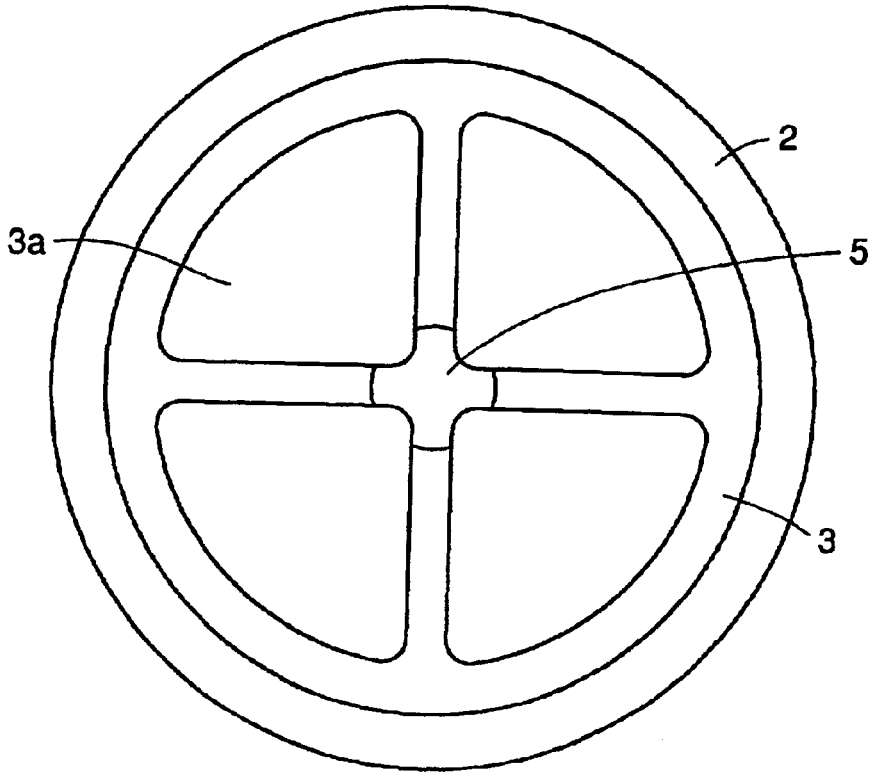
FIG. 14 is a view of the molded resin part of FIG. 13 viewed from the lower side.
Figure 15:
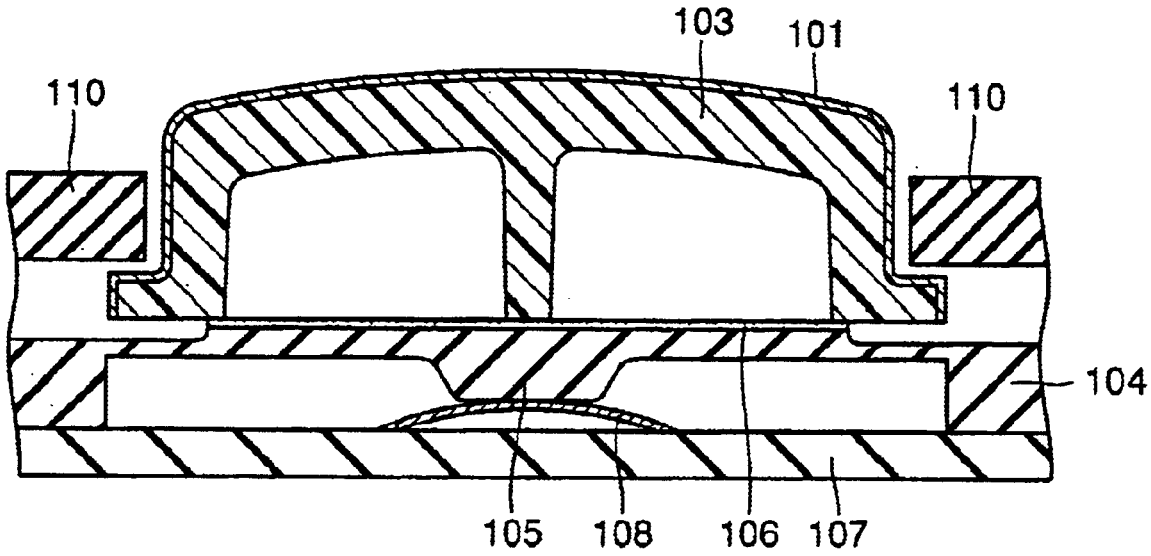
FIG. 15 PRIOR ART
FIG. 15 is a cross-sectional view schematically showing a structure of a press button switch according to a prior art.

Referring to FIGS. 13 and 14, a press button switch of the present embodiment is different from the structure of the first embodiment in the point that an actuator part 5 is provided to be integrated in the molded resin part 3 and in the point that the base rubber is omitted. Therefore, in the present embodiment, the switching operation is carried out through the pressing of the dome shaped metal plate 8 by the actuator part 5 provided to be integrated into the molded resin part 3.

Here, the other parts of the structure are almost the same as in the above described first embodiment and, therefore, the same parts are referred to by the same numerals, of which the descriptions are omitted.

According to a process of the present embodiment, a layered structure of the color film 1*a* and the plating layer 2 is prepared so as to be molded into a substantially curved shape as shown in FIG. 3 and, after that, the molded resin part 3 is formed to be integrated into the actuator part 5 in the injection molding step as shown in FIG. 4.

In the present embodiment, since the actuator part 5 is provided to be integrated into the molded resin part 3, the base rubber becomes unnecessary and the number of parts can be reduced.

Here, in the first to seventh embodiments, though after preparing the layered structure of the film 1*a*, 1*b*, the plating layer 2 (or a plating finish printed layer 12*a*) and the like the molding thereof into a button shape is carried out, the single layer of the film 1*a*, 1*b* is molded into a button shape and, after that, the plating layer 2 (or a plating finish printed layer 12*a*), a protective film layer 11 or a printed layer 12 may be formed through the contact with the shape of the film 1*a*, 1*b*.

As described above, a press button switch according to the present invention can be advantageously applied as a press button switch wherein a feeling of high quality through a metallic finish, a high degree of design freedom and prevention of color unevenness are required.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A press button switch for a switching operation through the pressing of a button, comprising:

a base body of said button;

a protective film formed on said base body;

an undercoat layer which is formed on said protective film and of which a surface, at least, exhibits a metallic color;

a printed layer over the undercoat layer;

a molded film which is formed over the printed layer and said undercoat layer so as to cover the printed layer and said undercoat layer, wherein the molded film and the printed layer allow transmission of the metallic color of said undercoat layer;

wherein said protective film substantially prevents heat from being conveyed from said base body to said undercoat layer.

2. The press button switch according to claim 1, wherein said molded film is a color film.

3. The press button switch according to claim 1, wherein said molded film is a colorless film.

4. The press button switch according to claim 1, wherein said printed layer has a designed pattern.

5. The press button switch according to claim 1, wherein said undercoat layer is a metal layer.

6. The press button switch according to claim 1, wherein said undercoat layer is a printed layer to which a plating-type finish is applied.

7. The press button switch according to claim 1, wherein an actuator for a switching operation is formed to be integrated into said base body.

8. The press button switch according to claim 1, wherein said base body has a hollow area.

9. A method of manufacturing a press button switch for a switching operation through the pressing of a button comprising:

molding a molded film in a button shape;

applying a printed layer to said molded film;

applying an undercoat layer to said printed layer;

exhibiting a metallic color with said undercoat layer;

forming a protective film over said undercoat layer;

contacting a base body with the protective film;

fixing the base body to said protective film;

transmitting said metallic color with said molded film and said printed layer; and preventing heat from being conveyed substantially from said base body to said undercoat layer with said protective film.

10. The method of manufacturing a press button switch according to claim 9, wherein said base body is formed after said molded film is formed in the button shape.

11. The method of manufacturing a press button switch according to claim 9, wherein said base body is formed simultaneously when said molded film is formed in the button shape.

12. A press button switch for a switching operation through the pressing of a button, comprising:

a base body of said button;

a layered film having a transparent film, a printed layer, and an undercoat layer formed of metal deposited on a back surface of said printed layer by vapor deposition, said undercoat layer exhibiting a metallic color at least at a surface thereof; and a protective film formed between said base body and said undercoat layer in order to prevent heat from being conveyed from said base body to said undercoat layer;

wherein said layered film is molded so that a back surface of said protective film covers said base body of said button.

* * * * *